United States Patent [19]

De Tomaso

[11] Patent Number: 4,809,663

[45] Date of Patent: Mar. 7, 1989

[54] HIGH PERFORMANCE INTERNAL COMBUSTION ENGINE

[75] Inventor: Alejandro De Tomaso, Modena, Italy

[73] Assignee: Officine Alfieri Maserati S.p.A., Modena, Italy

[21] Appl. No.: 926,523

[22] Filed: Nov. 4, 1986

[30] Foreign Application Priority Data

Nov. 4, 1985 [IT] Italy ..... 22710 A/85

[51] Int. Cl.[4] ..... F02B 15/00

[52] U.S. Cl. ..... 123/432; 123/90.44

[58] Field of Search ..... 123/90.44, 90.4, 90.22, 123/90.23, 90.33, 41.82 R, 308, 432

[56] References Cited

U.S. PATENT DOCUMENTS 3,351,044 11/1967 Pomeroy ..... 123/41.82 R 4,346,678 8/1982 Wherry ..... 123/90.33

4,519,365 5/1985 Anfusio ..... 123/432

4,638,774 1/1987 Aoi ..... 123/90.4

4,655,177 4/1987 Wells et al. ..... 123/90.33

4,658,780 4/1987 Hosoi ..... 123/90.22

FOREIGN PATENT DOCUMENTS 296125 8/1928 United Kingdom ..... 123/90.27

*Primary Examiner*—E. Rollins Cross

*Attorney, Agent, or Firm*—Fitzpatrick, Cella, Harper & Scinto

[57] ABSTRACT

A high performance, high reliability internal combustion engine comprises a 90-degree Vee-six cylinder block with six valves per cylinder, three intake and three exhaust ones, arranged circumferentially to the cylinder and having the top ends of their stems aligned along parallel axes.

7 Claims, 8 Drawing Sheets

HIGH PERFORMANCE INTERNAL COMBUSTION ENGINE

DESCRIPTION

The present invention relates to an internal combustion engine for motor vehicles, of the type which comprises a number of cylinders, each having respective intake and exhaust ducts opening into a combustion chamber formed in a cylinder head, respective valves each formed with a valve head and a stem and acting with said head on intake and exhaust ports at the combustion chamber, and means of driving said valves.

The problem underlying the present invention was that of providing an internal combustion engine having such structural and functional features as to afford high performance characteristics both in term of power output and reliable operation.

That problem is solved by an engine according to the invention, characterised in that there are six such valves provided for each cylinder, three acting in the intake path and three in the exhaust path, said valves having valve heads arranged circumferentially to said cylinder and the top ends of the respective valve stems aligned along parallel axes.

Further features and advantages of the inventive engine will become apparent from the following description of a preferred embodiment thereof, given herein by way of illustration and not of limitation with reference to the accompanying drawings.

Figure 1:
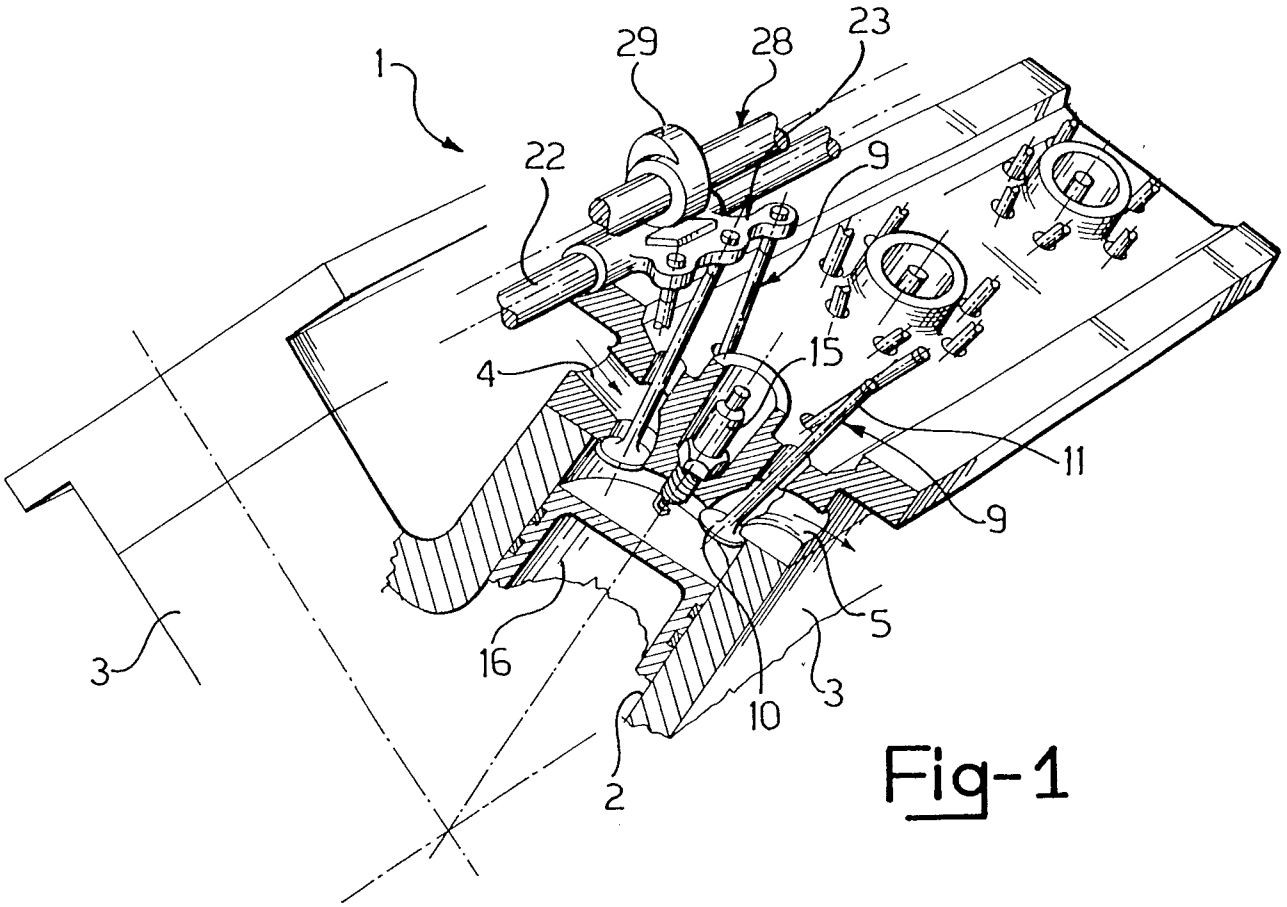
FIG. 1 is a perspective view showing diagramatically an internal combustion engine according to this invention.
Figure 2:
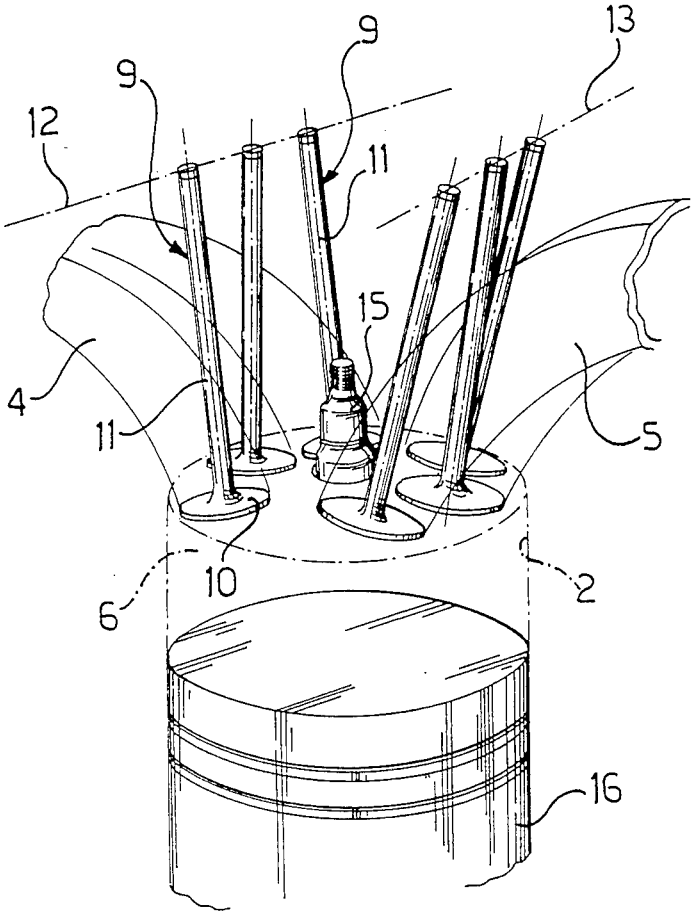
FIG. 2 is a perspective view showing diagramatically a detail of FIG. 1.
Figure 3:
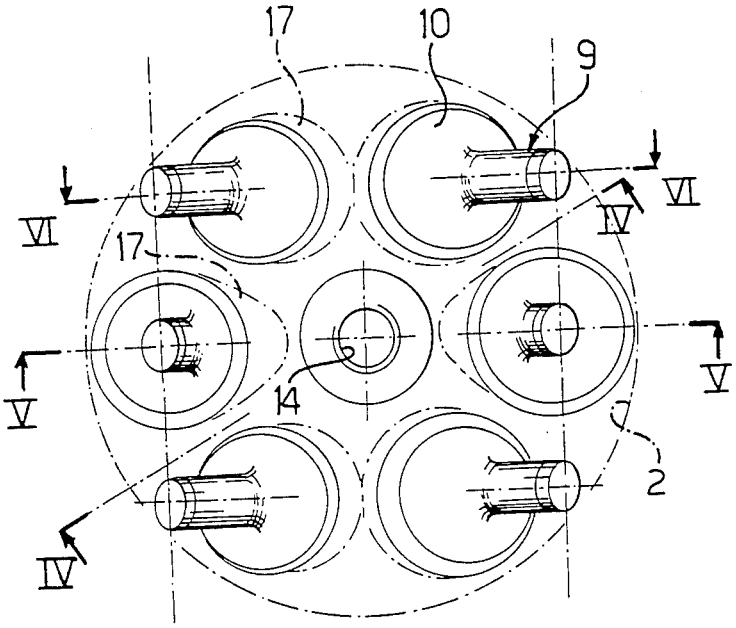
FIG. 3 is a diagramatic top plan view of the detail of FIG. 2.
Figure 4:
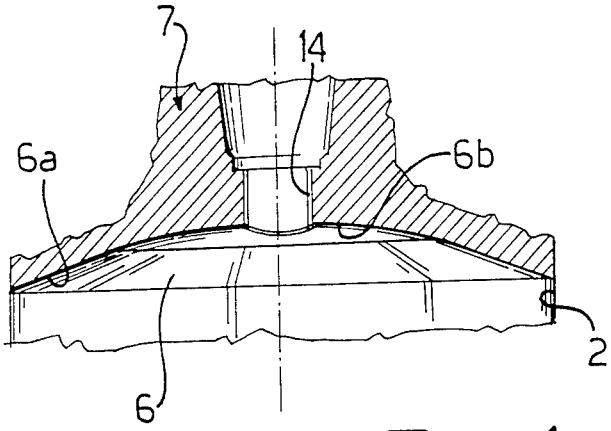
FIG. 4 is a scrap-sectional view taken along the line IV—IV in FIG. 3.

With reference to such drawing figures, an internal combustion engine, depicted schematically in FIG. 1, is comprehensively designated 1.

That engine has six cylinders 2 in a 90-degree Veed arrangement including two cylinder banks 3, and is supercharged by two conventional blowers, one for every three cylinders 2, not shown.

Reference will be made herein below, for clarity, to a single cylinder 2, as depicted in FIGS. 2 to 9, since its features and the devices connected with it are the equivalents of those of the other cylinders 2 throughout.

The cylinder 2, wherein a piston 16 is accommodated slidable, has intake and exhaust ducts 4 and 5, respectively, which open into a combustion chamber 6, detailedly described herein below and formed of a cast cylinder head 7 which includes, in addition to a top portion of the cylinder 2, and accordingly the combustion chamber 6, also a terminating section of the intake duct line 4 and a start section of the exhaust duct line 5.

The ducts 4 and 5 are in communication with the combustion chamber 6 through circular cross-section ports 8, three for each of the ducts 4 and 5, which are formed in the cylinder head 7 at the combustion chamber 6 and arranged circumferentially to the cylinder 2.

Furthermore, the ports 8 of the intake duct 4 indicated at **8*a* in the drawings have a larger diameter than the ports 8*b* of the exhaust duct 5** and form valve seats.

The engine 1 of this invention includes, therefore, six valves 9 for each cylinder 2, each comprised of a valve head 10 to which the bottom end of a valve stem 11 is attached, said valves 9 acting with their heads 10 on the valve seats 8 of the ducts 4 and 5.

The valve heads 10 are, therefore, arranged circumferentially to said cylinder 2 and internally tangential to it. Also, the stems 11 of the three intake valves and the three exhaust valves have axes lying coplanarly in pairs and converging into the combustion chamber 6.

Such valve stems 11 are then fitted slidably into cylindrical guides 19 formed in the cylinder head 7 and extend outward of said head.

The valve stems 11 of the three valves 9 acting n the intake duct 4 have their top ends aligned along an axis 12; top ends of the valve stems 11 of the valves 9 acting in the exhaust duct 5 are instead aligned along a parallel axis 13 to the axis 12.

Splitting the intake and exhaust ducts 4 and 5, and the consequent use of six valves 9 per cylinder 2, affords improved fuel feed conditions to the combustion chamber 6 and a faster-rate exhausting of the burned gases. Accordingly, the power delivered by the engine of this invention is greatly increased.

The combustion chamber 6 has a combustion chamber top **6*a* of substantially frusto-conical shape topped by a domed portion 6*b***.

In the cylinder head 7, at the domed portion **6*b*, there is formed centrally a threaded seat 14 coaxial with the cylinder 2 for receiving a spark plug 15 therein, at a barycentric location with respect to the valves 9**.

During a fuel compression stroke within the combustion chamber 6, the fuel is forced by the piston 16 into the domed portion **6*b*** by virtue of the so-called "squeeze effect". Thus, ignition and combustion take place in a decreased volume chamber, to afford improved conversion of the heat energy to kinetic energy.

Moreover, thanks to position of the spark plug 15, combustion occurs more rapidly, affording reduced ignition advance settings and a higher burned gas pressure.

Substantially spherical impressions 17 are formed in the cylinder head 7 around the valve seats 8, and hence, around the valve heads 10 acting on the valve seats 8, and have their concave sides arranged to face the combustion chamber 6.

The impressions 17 are oriented in set directions and provide a turbulent gas flow within the combustion chamber 6.

Figure 5:
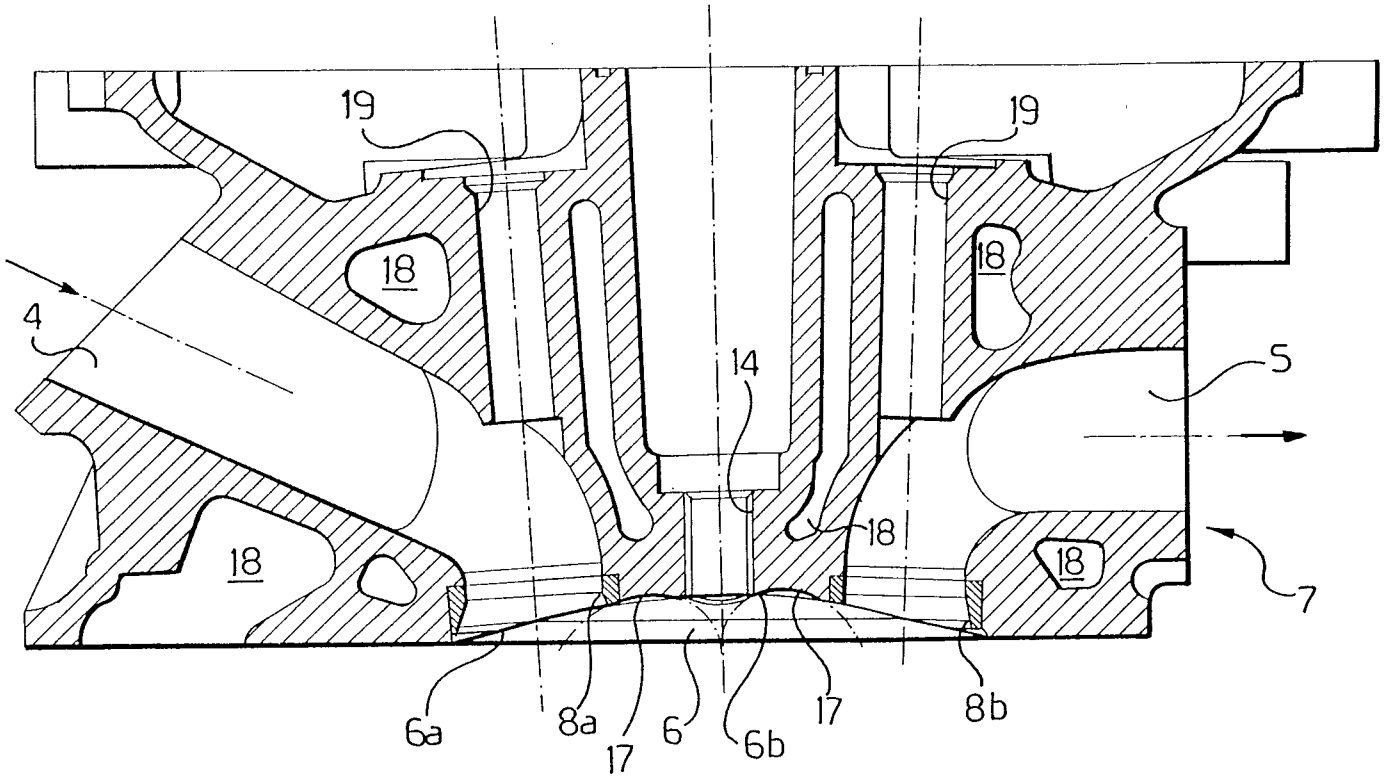
FIG. 5 is a fragmentary view of a detail of FIG. 1 in section along the line V—V of FIG. 3.
Figure 6:
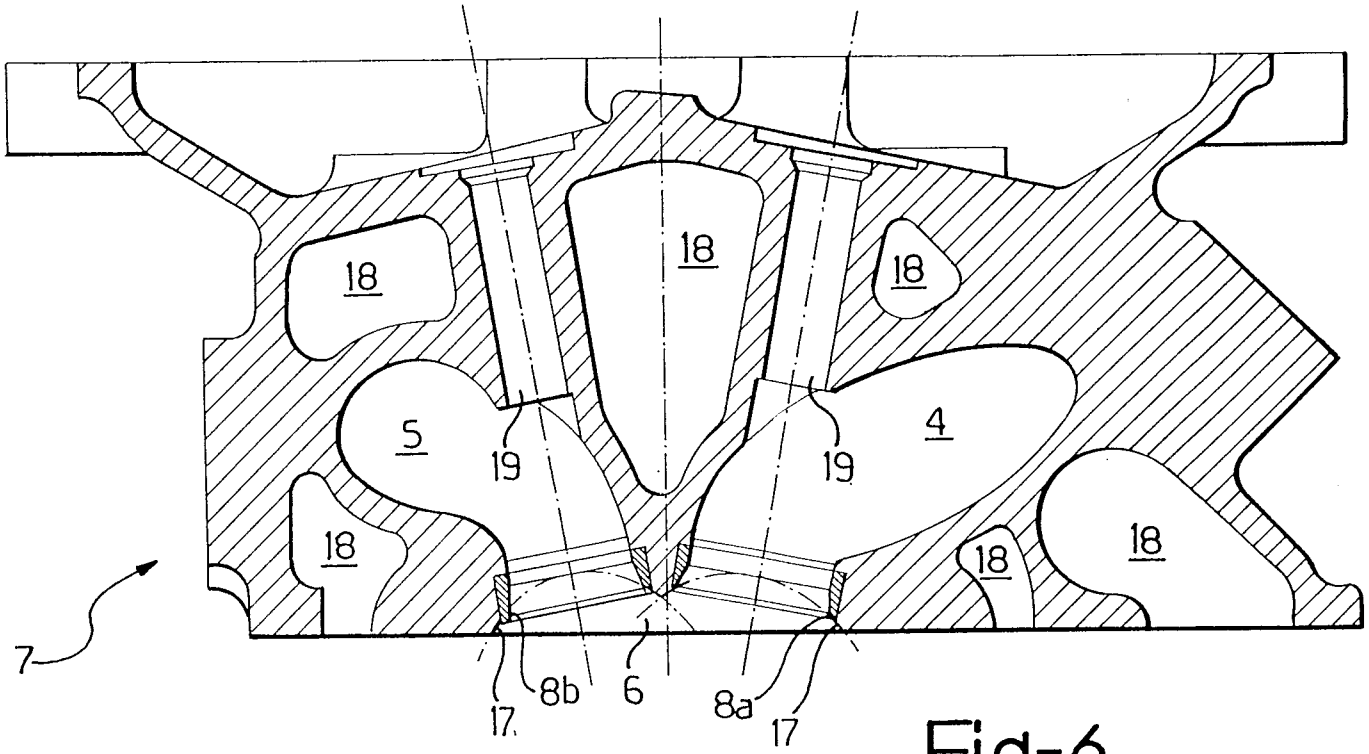
FIG. 6 is a fragmentary view of the detail of FIG. 1 in section along the line VI—VI of FIG. 3.
Figure 7:
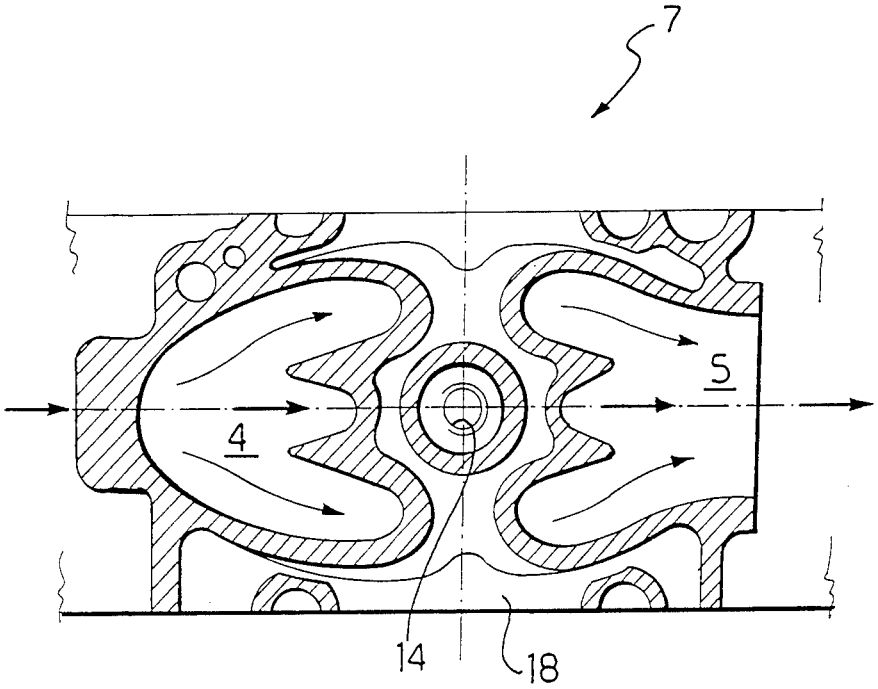
FIG. 7 is a top plan view of a detail of FIG. 1 in section on a plane tilted through 45°.
Figure 8:
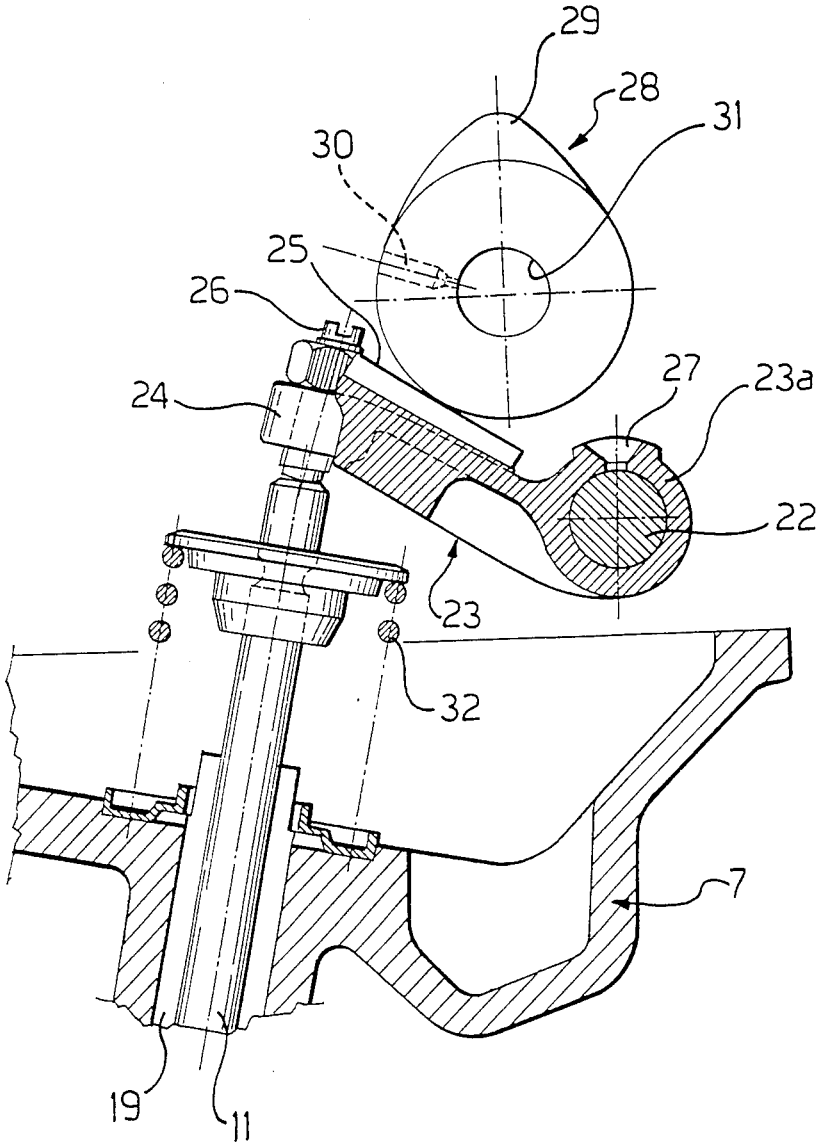
FIG. 8 is a part-sectional side view of a detail of FIG. 1.
Figure 9:
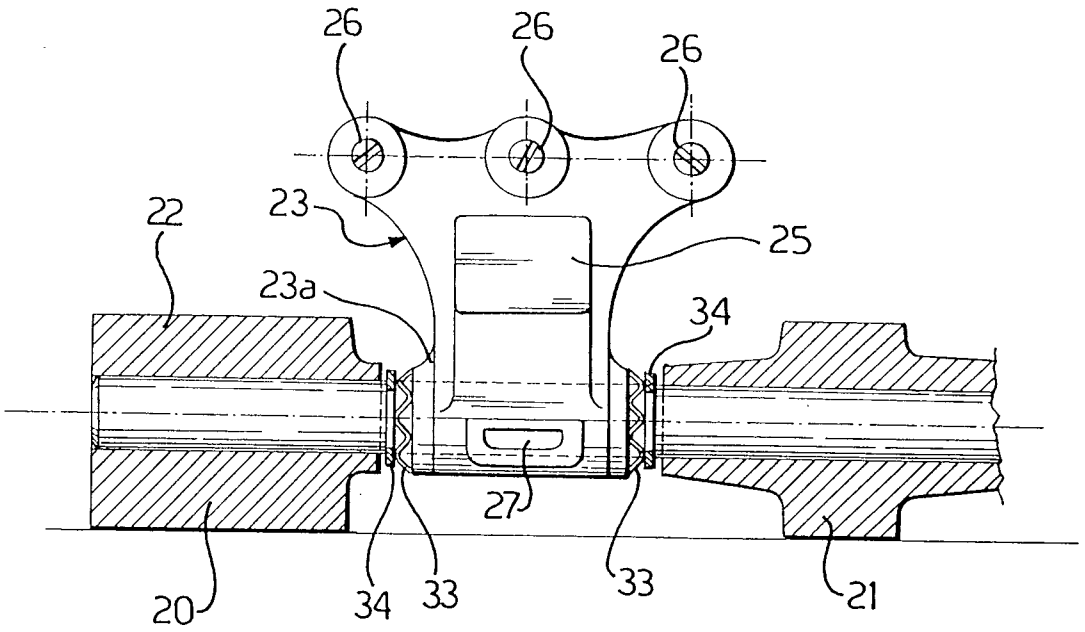
FIG. 9 is a part-sectional plan view showing diagramatically a detail of FIG. 1.

The cylinder head 7 is also formed with intercommunicating cavities, collectively indicated at 18 in FIGS. 5,6 and 7; the cavities 18 are located both near the intake and exhaust ducts 4 and 5, and around the seat 14 accommodating the ignition spark plug 15, and are adapted to be swept by a cooling fluid.

The cavities 18 near the exhaust duct 5 have a larger size than the cavities 18 formed near the intake duct 4.

Thus, effective cooling is provided for the entire cylinder head 7, especially at its hottest spots adjoining the exhaust duct 5, as well as optimum cooling of the spark plug 15.

The engine 1 further comprises driving means for the valves 9, which are comprised, in turn, of rocker arms 23 each having a sleeve end 23*a* pivoted on a pin 22 and a juxtaposed end configured with three arms 24, each arm 24 being active on the top end of the valve stem 11 of a respective valve 9.

Each arm 24 acts on a respective valve stem 11 by the action of a cam 29 on a camshaft 28 carried in the engine 1 against the bias of conventional spring-loaded means 32 effective to constantly bias the valve 9 toward a closed position with the valve head 10 in contact with the valve seat 8.

At one end contacting the top end of the stem 11, each arm 24 is provided with an adjustment screw 26, and a shoe 25 is secured to the arm 24 which intervenes between the arm itself and a cam 29 on the camshaft 28.

The pin 22 supporting the rocker arms 23 is carried conventionally on mounts 20 and 21 in mutual spaced apart relationship, supported, in turn, on the cylinder head 7.

The sleeve end 23*a* of the rocker arm 23 is journalled on a portion of the pin 22 extending between mounts 20 and 21; the rocker arm 23 is retained axially on the pin 22 itself between two shoulders 33 formed on the pin 22, between the rocker arm 23 and each shoulder 33 there intervening a wave spring washer 34.

In actual practice, the shoulders 33 would be respective retainer rings mounted on the pin 22. With the inventive engine, positioning the rocker arm 23 on the pin 22 results in decreased space requirements along the pin 22 axis, thereby affording a less scanty sizing of the mounts 20 and 21 and avoiding, in consequence, any deflection of the pin 22.

Furthermore, the washers 34 apply oppositely directed forces to the rocker arm 23, thereby no load is imposed on the mounts 20 and 21 in the direction of the pin 22 axis.

In each cam 29 of the camshaft 28 there is formed a calibrated hole 30 radially therethrough which is in fluid communication with the outside and with a conduit 31 formed axially through the camshaft 28.

The conduit 31 is intended for containing oil under pressure such that, owing to the camshaft 28 being driven rotatively, the oil is caused to flow out through the throughgoing hole 30 and be thrown outward from the camshaft 28 to lubricate a surface of the shoe 25 in contact with the cam 29.

Each rocker arm 23 is further provided, at the pin 22 location, with a flared cavity 27 facing upwards and having raised edges, being formed on the sleeve end 23*a*. That cavity 27 opens downwardly to the pin 22.

It should be noted that the cavity 27 forms a reservoir or well for collecting the oil thrown out from the camshaft 28, and ensures optimum lubricating conditions for the pin 22 on which the rocker arm 23 is journalled.

The engine of this invention has shown an ability to deliver higher power ratings, for a given piston displacement, than conventional design engines.

Furthermore, by virtue of the effectiveness of the cooling and lubricating provisions just described, its reliability of operation is greatly improved.

I claim:

1. An internal combustion engine comprising:

a plurality of engine cylinders each having respective intake and exhaust ducts opening into a combustion chamber formed in a cylinder head;

respective valves each having a valve head and stem and acting with said valve heads in said intake and exhauast ducts at said combustion chamber;

driving means for said valves;

each cylinder having six of said valves, three of which are arranged to act in an intake duct and three in an exhaust duct, said valves having their valve heads arranged circumferentially to said engine cylinder and in a circular pattern, and the top ends of their respective valve stems aligned along parallel axes, said combustion chamber being formed with a frustoconically shaped upper region topped by a domed portion and an ignition spark plug seat formed centrally in said domed portion at a barycentric location with respect to said valves, and said valves being equally spaced from the apex of said domed portion.

2. An engine according to claim 1, characterised in that formed in said cylinder head are substantially hemispherical impressions arranged around the valve heads of said valves.

3. An engine according to claim 1, characterised in that formed in said cylinder head are intercommunicating cavities located near said intake and exhaust ducts and around said seat accommodating the ignition spark plug, being intended to be swept through by a cooling fluid.

4. An engine according to claim 1, characterised in that said valve diriving means comprise rocker arms having one end journalled on a pin and a juxtaposed end configured with three arms, each arm being arranged to act on the valve stem of a respective valve by the action of a cam on a camshaft, each rocker arm being retained axially on the pin by two shoulders formed on the pin itself, a wave spring washer being interposed to the rocker arm and each shoulder.

5. An engine according to claim 4, characterised in that each cam on the camshaft has a hole formed radially therethrough and in fluid communication with a conduit formed axially through the camshaft.

6. An engine according to claim 5, characterised in that each rocker arm is provided, at the pin, with a respective flared cavity facing upwards and being open downwardly to the pin, said cavity forming an oil reservoir.

7. An engine according to claim 2, characterized in that formed in said cylinder head are interconnecting cavities located near said intake and exhaust ducts and around said seat accommodating the ignition spark plug, being intended to be swept through by a cooling fluid.

* * * * *

UNITED STATES PATENT AND TRADEMARK OFFICE

CERTIFICATE OF CORRECTION

PATENT NO. : 4,809,663

DATED : March 7, 1989

INVENTOR(S) : ALEJANDRO DE TOMASO

It is certified that error appears in the above-identified patent and that said Letters Patent is hereby corrected as shown below:

COLUMN 1

Line 32, "diagramatically" should read --diagrammatically--.
Line 35, "diagramatically" should read --diagrammatically--.
Line 37, "diagramatic" should read --diagrammatic--.
Line 51, "gramatically" should read --grammatically--.
Line 66, "herein below" should read --hereinbelow--.

COLUMN 2

Line 24, "n" should read --in--.

UNITED STATES PATENT AND TRADEMARK OFFICE

CERTIFICATE OF CORRECTION

PATENT NO. : 4,809,663

DATED : March 7, 1989

INVENTOR(S) : ALEJANDRO DE TOMASO

It is certified that error appears in the above-identified patent and that said Letters Patent is hereby corrected as shown below:

COLUMN 4

Line 14, "exhauast" should read --exhaust--.
Line 24, "conically shaped" should read --conically-shaped--.
Line 41, "valve diriving means comprise" should read --valve driving means comprises--.

Signed and Sealed this

Fifth Day of December, 1989

*Attest:*

JEFFREY M. SAMUELS

*Attesting Officer*

*Acting Commissioner of Patents and Trademarks*